US010392233B2

(12) United States Patent
Mayer

(10) Patent No.: US 10,392,233 B2
(45) Date of Patent: Aug. 27, 2019

(54) CRANE TOWER

(71) Applicant: Liebherr-Werk Biberach GmbH, Biberach an der Riss (DE)

(72) Inventor: Joachim Mayer, Biberach an der Riss (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 0 days.

(21) Appl. No.: 15/560,930

(22) PCT Filed: Mar. 23, 2016

(86) PCT No.: PCT/EP2016/000513
§ 371 (c)(1),
(2) Date: Sep. 22, 2017

(87) PCT Pub. No.: WO2016/150570
PCT Pub. Date: Sep. 29, 2016

(65) Prior Publication Data

US 2018/0044147 A1 Feb. 15, 2018

(30) Foreign Application Priority Data

Mar. 26, 2015 (DE) ..... 10 2015 003 982

(51) Int. Cl.
*E04H 12/20* (2006.01)
*B66C 23/28* (2006.01)
(Continued)

(52) U.S. Cl.
CPC ..... *B66C 23/283* (2013.01); *B66C 23/02* (2013.01); *B66C 23/74* (2013.01); *E04H 12/20* (2013.01)

(58) Field of Classification Search
CPC ..... B66C 23/283; B66C 23/74; B66C 23/02; E04H 12/20; E04H 12/16
(Continued)

(56) References Cited

U.S. PATENT DOCUMENTS 1,920,370 A * 8/1933 Forsythe ..... B66C 23/66 212/177
2,682,432 A * 6/1954 Schmidt ..... A62B 5/00 182/2.11
(Continued)

FOREIGN PATENT DOCUMENTS

DE 2324184 A1 11/1973
DE 2818993 A1 12/1979
(Continued)

OTHER PUBLICATIONS

ISA European Patent Office, International Search Report Issued in Application No. PCT/EP2016/000513, dated Jun. 27, 2016, WIPO, 6 pages.

*Primary Examiner* — Brent W Herring
(74) *Attorney, Agent, or Firm* — McCoy Russell LLP

(57) ABSTRACT

The present invention relates to a crane tower comprising a crane tower base, which has a crane tower or a crane tower element fixed thereto and from which the crane tower extends upwards, and a tension element for bracing the crane tower 1 on the crane tower base. The tension element has one of its two ends connected to the crane tower base and its respective other end connected to the crane tower or to a coupling element that is connected to the crane tower. The crane tower is characterized in that the tension element extends outside of the crane tower. It is thus possible to reduce the dimensions of the crane tower without causing any change of bending resistance or to increase the bending resistance on the basis of the same dimensions.

20 Claims, 3 Drawing Sheets

(51) Int. Cl.
*B66C 23/02* (2006.01)
*B66C 23/74* (2006.01)

(58) Field of Classification Search
USPC ..... 52/212, 633, 111, 40, 223.1, 223.4, 52/223.5, 651.01, 651.05, 146
See application file for complete search history.

(56) References Cited

U.S. PATENT DOCUMENTS 3,194,412 A * 7/1965 Kerridge ..... B66C 23/283 212/176
3,534,867 A * 10/1970 Ghysels ..... B66C 23/701 212/264
3,631,988 A * 1/1972 Noly ..... B66C 23/342 212/231
3,638,806 A * 2/1972 Hippach ..... B66C 23/703 212/231
3,877,192 A 4/1975 Metailler
3,922,789 A * 12/1975 Sarrell ..... B66C 23/905 116/202
4,028,792 A * 6/1977 Tax ..... B66C 23/283 29/431
4,184,165 A * 1/1980 Vye ..... H01Q 9/24 343/861
4,187,949 A * 2/1980 Komatsu ..... B66C 23/605 212/240
4,286,722 A * 9/1981 Tax ..... B66C 13/08 212/242
4,406,375 A * 9/1983 Hockensmith ..... B66C 23/707 212/348
4,685,253 A * 8/1987 Bitterly ..... E04C 3/10 52/2.11
4,899,500 A * 2/1990 Miller ..... E04H 5/02 52/146
4,982,853 A * 1/1991 Kishi ..... B66C 23/701 212/230
5,101,215 A * 3/1992 Creaser, Jr. ..... E04H 12/182 343/883
5,259,159 A * 11/1993 Kawase ..... E02D 27/34 52/1
7,172,082 B2 * 2/2007 Irsch ..... B66C 23/828 212/231
7,516,858 B2 * 4/2009 Willim ..... B66C 23/66 212/168
7,828,162 B2 * 11/2010 Wiesbauer ..... B66C 23/185 212/238
8,192,129 B1 * 6/2012 Orgeron ..... E21B 19/155 212/255
8,297,025 B2 * 10/2012 Huynh Tuong ..... E04H 12/02 52/745.17
8,308,000 B2 * 11/2012 Wiesbauer ..... B66C 23/185 212/180
8,322,093 B2 * 12/2012 Zavitz ..... E04H 12/12 52/223.5
8,458,970 B2 * 6/2013 Zavitz ..... E04H 12/12 52/223.5
8,696,288 B2 * 4/2014 Orgeron ..... E21B 19/155 212/255
8,794,457 B2 * 8/2014 Richter ..... B66C 13/08 212/256
8,904,722 B2 * 12/2014 Smith ..... E04H 12/16 52/114
8,944,262 B2 * 2/2015 Willim ..... B66C 23/185 212/273
9,102,507 B2 * 8/2015 Willim ..... B66C 23/76
9,266,701 B2 * 2/2016 Bosco ..... B66C 23/207
9,617,752 B2 * 4/2017 Wagner ..... F03D 13/20
9,840,401 B2 * 12/2017 Hansen ..... B66C 13/06
9,856,121 B2 * 1/2018 Bjorshol ..... B66C 23/10
10,053,340 B2 * 8/2018 Albinger ..... B66C 23/821
2002/0070187 A1 * 6/2002 Willim ..... B66C 23/701 212/299
2004/0168997 A1 * 9/2004 Irsch ..... B66C 23/828 212/195
2006/0096940 A1 * 5/2006 Willim ..... B66C 23/66 212/300
2006/0096941 A1 * 5/2006 Stoetzer ..... E02D 7/16 212/347
2008/0169258 A1 * 7/2008 Weisbauer ..... B66C 23/185 212/296
2010/0005731 A1 * 1/2010 Marvin ..... E04H 12/10 52/40
2010/0031589 A1 * 2/2010 Fernald ..... E02D 27/42 52/173.1
2010/0102018 A1 * 4/2010 Weisbauer ..... B66C 23/185 212/296
2011/0138704 A1 * 6/2011 Bagepalli ..... E04H 12/12 52/147
2011/0272377 A1 * 11/2011 Willim ..... B66C 13/06 212/285
2011/0283640 A1 * 11/2011 Miller ..... E02D 27/42 52/292
2012/0061341 A1 * 3/2012 Richter ..... B66C 13/06 212/348
2013/0001182 A1 * 1/2013 Willim ..... B66C 23/76 212/276
2014/0033628 A1 * 2/2014 Lockwood ..... E04H 12/16 52/223.5
2014/0083022 A1 * 3/2014 Nummi ..... E04H 12/10 52/40
2014/0131300 A1 * 5/2014 Scampini ..... B66C 23/34 212/300
2014/0202971 A1 * 7/2014 Bosco ..... B66C 23/207 212/296
2014/0215930 A1 * 8/2014 Zavitz ..... E04H 12/16 52/40
2014/0260014 A1 * 9/2014 Smith ..... E04H 12/16 52/223.1
2015/0014266 A1 * 1/2015 Rafailovic ..... B66C 23/16 212/176
2015/0052836 A1 * 2/2015 Kirkley ..... E04H 12/342 52/223.5
2015/0183620 A1 * 7/2015 Hansen ..... B66C 13/06 212/273
2015/0308139 A1 * 10/2015 Wagner ..... F03D 13/20 52/1
2015/0330077 A1 * 11/2015 Stracke ..... E04H 12/16 52/173.1
2016/0010621 A1 * 1/2016 Zuteck ..... B66C 23/207 52/40
2016/0010623 A1 * 1/2016 Zuteck ..... F03D 13/20 52/116
2016/0017868 A1 * 1/2016 Lockwood ..... E04H 12/16 52/223.5
2016/0145850 A1 * 5/2016 Cook ..... B29B 11/14 52/309.14
2016/0258421 A1 * 9/2016 Agassi ..... F03D 13/20
2017/0183203 A1 * 6/2017 Verchere ..... B66C 23/06
2017/0334686 A1 * 11/2017 Hess ..... B66C 23/905
2018/0022583 A1 * 1/2018 Hansen ..... B66C 23/52

FOREIGN PATENT DOCUMENTS

DE 102005008087 A1 5/2006
DE 102005049606 A1 * 4/2007 ..... B66C 23/42
DE 202012012884 U1 6/2014
EP 1657210 A1 5/2006
EP 1657211 A2 * 5/2006 ..... B66C 23/66
EP 1900675 B1 10/2010
FR 433044 A 12/1911
FR 2031876 A5 11/1970
FR 2803865 A1 7/2001
FR 2984865 A1 6/2013
JP 59010623 A * 1/1984 ..... E02D 27/50
WO 2013139116 A1 9/2013

* cited by examiner

CRANE TOWER

CROSS-REFERENCE TO RELATED APPLICATION

The present application is a U.S. National Phase of International Patent Application Serial No. PCT/EP2016/000513, entitled "CRANE TOWER," filed on Mar. 23, 2016. International Patent Application Serial No. PCT/EP2016/000513 claims priority to German Patent Application No. 10 2015 003 982.2, filed on Mar. 26, 2015. The entire contents of each of the abovementioned applications are hereby incorporated by reference in their entirety for all purposes.

TECHNICAL FIELD

The present invention relates to a crane tower as well as to a rotating tower crane comprising this crane tower.

BACKGROUND AND SUMMARY

An important element of cranes is the crane tower, which accounts to a substantial degree for the achievable crane hook height. In top-slewing tower cranes, the crane tower has the function of dissipating the occurring loads from the upper part of the crane as well as forces acting on the upper part to the base point of the crane tower.

Forces occurring and straining the crane tower are in particular the dead weight of the crane components, loads occurring due to momentums caused by a load on a load hook or by a counter ballast on the counter jib, loads resulting from traveling movements of the crane and loads caused when the crane is subjected to wind.

In conventional cranes, the various influences and loads are typically dissipated by selecting a suitable structural design of the tower. In most cases, the tower is therefore configured as a truss supporting structure, in the case of which the bending moments occurring, i.e. moments that may result in a deformation of the crane tower which projects perpendicularly from the base, are dissipated via usually three or four corner posts. The horizontal moments and the torsional loads are dissipated to the base point via the bracing with diagonal elements in the crane tower.

The dimensions of welded components are here normally chosen such that the maximum admissible dimensional limits for transport will not be exceeded and that the transport can still be carried out at a reasonable price.

Aspects that are opposed to this endeavor are the highest possible hook height and the highest possible bending resistance of the crane, which necessitate suitable dimensions of the components of the tower, whereby the crane tower is rendered heavy and expensive. These two opposite endeavors cannot be united by conventional cranes. The maximum hook height remains limited, since certain limits are set by the economy of transport and also by the realization of a crane transport. If particularly high hook heights are required, the cross-section of the tower is therefore stepped, with larger tower components being used in a lower area of the crane tower. Towards the upper end, the tower cross-section gets smaller step by step. Nevertheless, the transport expenditure is enormous.

It is the object of the present invention to increase the load bearing capacity of a crane tower and to dimension the components of a crane tower such that they can be transported more easily and have smaller transport dimensions, although their load capacity remains the same.

This object is achieved by a crane tower having a crane tower base, which has a crane tower fixed thereto and from which the crane tower extends upwards, and a tension element for bracing the crane tower on the crane tower base, the tension element having one of two ends connected to the crane tower base and the respective other end connected to the crane tower or to a coupling element that is connected to the crane tower, wherein the tension element extends outside of the crane tower.

The crane tower comprises here a crane tower base, which has a crane tower fixed thereto and from which the crane tower extends upwards, and a tension element for bracing the crane tower on the crane tower base, the tension element having one of its two ends connected to the crane tower base and its respective other end connected to the crane tower or to a coupling element that is connected to the crane tower. In addition, the crane tower is characterized in that the tension element extends outside of the crane tower.

A crane tower is a crane superstructure which stands up preferably vertically and which has the crane jib fixed thereto and thus accounts to a substantial degree for the achievable crane hook height. Typically, the crane tower consists of a plurality of interconnectable mast sections representing individual elements of the crane tower that are adapted to be connected to one another. In the case of "climbing-type" cranes, mast sections are incorporated into a crane tower which is already connected to the fully assembled upper part of the crane. This is normally done by means of a hydraulic pump arranged on the crane tower, said hydraulic pump pressing the upper part of the crane upwards thus providing free space for a mast section element to be inserted. By repeating the insertion process, the crane tower increases in height. The term mast section stands for prefabricated subsections of the crane tower.

The crane tower base describes the element from which the crane tower extends upwards and which transmits the forces coming from the crane tower into the ground. The crane tower base may e.g. be a crane foundation, an X-pattern foundation or an undercarriage. The crane foundation is normally a concrete foundation whose upper side is preferably approximately flush with the ground level.

The tension element for bracing the crane tower preferably comprises a brace and/or a rope. By means of the tension element, a point of the crane tower or a coupling element connected to the crane tower is connected to the crane tower base via the tension element, so that the point of the crane tower connected to the tension element, or the coupling element is pulled in the direction of the crane tower base or braced.

In addition, the tension element extends outside of the crane tower. Preferably, this means that the cross-sectional area defined by the plurality of corner posts of the mast section and of the crane tower, respectively, will not collide with a tension element.

A coupling element that may perhaps also be rigidly connected to the crane tower is not taken into account in the definition of the cross-sectional area of the crane tower, since a coupling element does not have any influence whatsoever on the maximum dissipatable bending forces of a crane tower. Hence, the only important aspect preferably is that the tension element extends outside of a cross-sectional area of the crane tower, whose corner points are defined by the plurality of corner posts of the crane tower, preferably by three or four such corner posts.

A coupling element may be considered to be any element which projects rigidly from the crane tower and which comprises a point outside of the cross-sectional area defined by the plurality of corner posts of a crane. A typical characteristic of a coupling element is that it is rigidly connected to the crane tower and that it has a fundamentally rigid basic structure. Preferably, the coupling element of a crane tower may be a bracket, an adapter piece to a different type of crane tower or a ball slewing ring support. As has already been explained hereinbefore, it will be of advantage when the point connected to the tension element is located outside of a cross-sectional area of a crane tower element (mast section). The cross-section extends in a plane which is perpendicular to the longitudinal direction of the crane tower. The cross-sectional area is preferably determined by the mast section that is directly connected to the crane tower base.

It follows that, when the crane element connected to the crane tower base has a cross-sectional area which is smaller than that of a mast section arranged above said crane element, a connection of the tension element at points located beyond the cross-sectional area of the mast section connected to the crane tower base is comprised by the present invention.

Preferably, the coupling element, which is connected to one end of the tension element, projects from the crane tower. It projects advantageously in a direction perpendicular to the longitudinal direction of the crane tower.

According to a further, optional, advantageous feature, the tension element extends substantially parallel to the longitudinal direction of the crane tower, i.e. in the case of a rotating tower crane it extends substantially parallel to the vertical. This arrangement of the tension element leads to a space-saving realization of the invention, since a compact crane tower base will here accompany the realization of the invention. Moreover, when a tension element extends parallel to the longitudinal direction of the crane tower, the amount of material that has to be used for the tension element with regard to a maximum height to be reached will be minimal.

Preferably, the crane tower according to the present invention comprises a second tension element, said second tension element being preferably arranged such that it is located in a common plane together with the first tension element, said plane comprising the longitudinal direction of the crane tower or extending parallel to the longitudinal direction of the crane tower. By providing a second tension element, the bending moments acting on the crane can be compensated for in more than one direction. The person skilled in the art will be aware that the present invention is not limited to a maximum of two tension elements. On the contrary, it makes sense to provide additional tension elements so as to compensate or weaken bending forces occurring from several directions with the aid of a plurality of tension elements.

An additional advantageous further development of the invention describes that the first tension element and the second tension element are arranged mirror-symmetrically with respect to a mirror plane, the mirror plane extending preferably through the longitudinal axis of the crane tower. In this context, each of the first and second tension elements may also be connected to an associated coupling element (provided separately for each of the tension elements). Preferably, it is also possible that both tension elements extend parallel to the longitudinal axis of the crane tower.

In this context, it is imaginable to configure the tension element as a jacketed, high-strength fiber rope, the fiber rope comprising preferably aramid fibers. These high-strength, jacketed fiber ropes are able to bear particularly high loads and are particularly resistant and their load bearing capacity can easily be adapted to the characteristics demanded. Moreover, they have a very low weight and, due to their flexibility, they are ideal for forming tension members of increased length. In addition, they can be transported preferably in a condition in which they are wound onto a drum and they can be installed with little mounting effort. This results in savings as regards crane transport and mounting.

Preferably, it is also imaginable to provide a structural design of a crane tower comprising a plurality of coupling elements, which project from the crane tower and are arranged one above the other in a vertical direction and in the case of which the tension element extends from a next higher coupling element to a coupling element located therebelow, and is connected to the latter.

The crane tower base is here the section of the crane tower, which is connected to the coupling element located below a next higher coupling element. A crane tower element, which preferably corresponds to a mast section, extends from the crane tower base upwards and is connected to the crane tower base via a tension element. Hence, a plurality of bracing planes is formed, and planes adjoining one another are interconnected by a tension element. This realization of the invention is particularly advisable in the case of climbing-type cranes. Thus, a crane tower according to the present invention will be realizable, i.e. the crane tower can be provided with a tension element, when a specific height has been reached, and also the tension elements can be allowed to climb as the height of the crane increases.

The present invention additionally relates to a rotating tower crane including a crane tower according to one of the preceding embodiments, the rotating tower crane being preferably a top-slewing tower crane.

Additional advantages and details will be described in more detail hereinafter making reference to the embodiments shown in the drawings.

DETAILED DESCRIPTION

Figure 1:
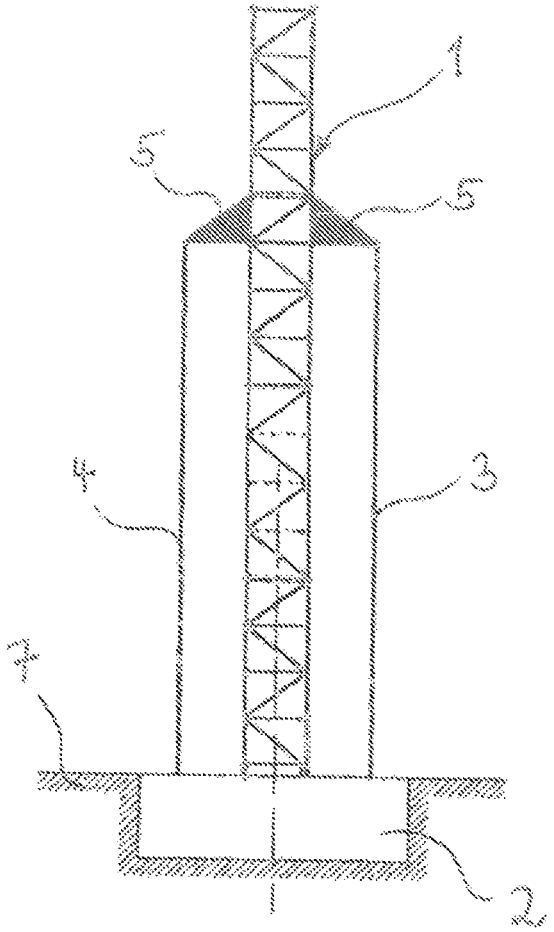
FIG. 1 shows a side view of a crane tower according to the present invention.

FIG. 1 shows a crane tower 1 that is fixed to a crane tower base 2. The crane tower base 2 has an upper surface, which faces the crane tower 1 and whose level is similar to that of the ground 7 surrounding the crane tower base 2. On a level spaced apart from the crane tower base 2, the crane tower 1 has provided thereon coupling elements 5 projecting from the crane tower 1. Each coupling element 5 has a tension element 3; 4, which is associated therewith and which connects the coupling element 5 to the crane tower base 2. The tension element 3; 4 extends downwards from its point of connection with the coupling element 5, substantially parallel to the longitudinal direction of the crane tower 1. Alternatively, the tension element 3; 4 may, however, also extend, in a manner that is here not shown, at an oblique angle or "criss-cross" relative to the crane tower base 2 from its point of connection with the coupling element 5. Due to the bracing of the tension element, the crane tower 1 can take up higher bending forces, thus allowing smaller dimensions of the rigid crane tower elements without causing any change of bending resistance. The crane superstructure can thus be transported more easily.

Figure 2:
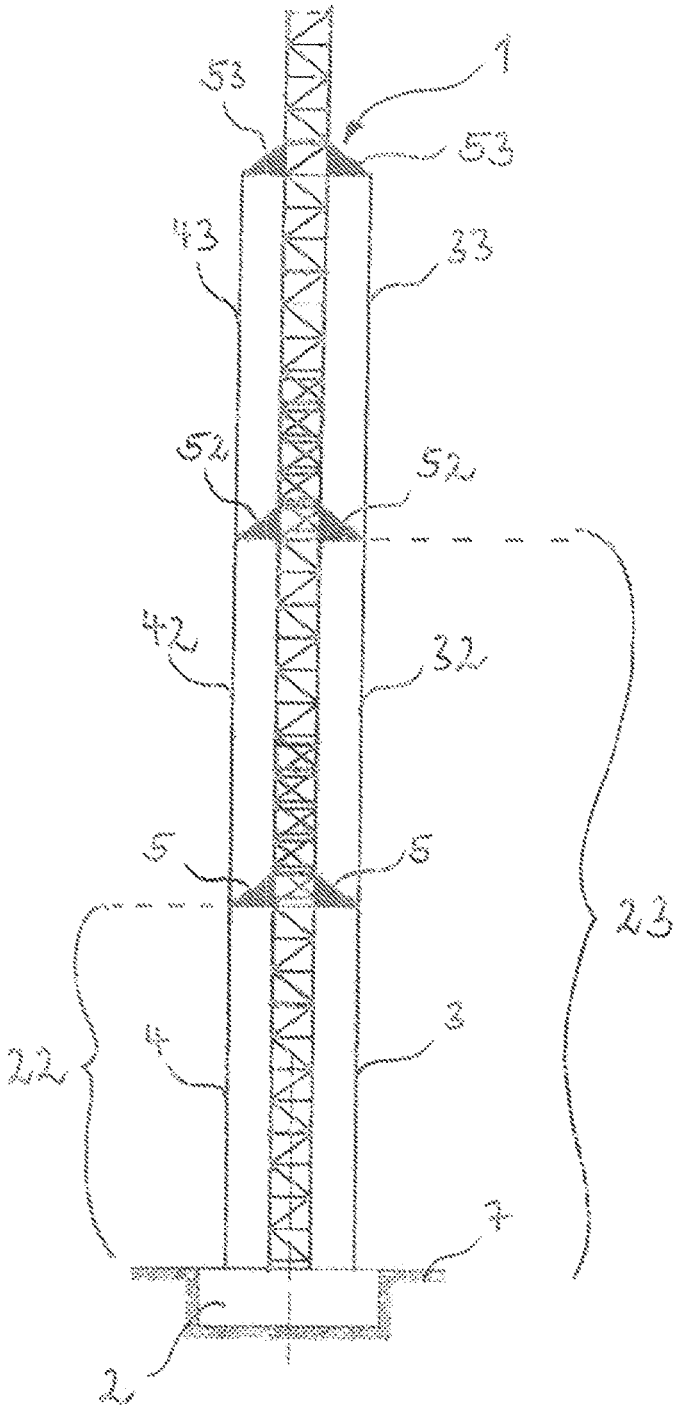
FIG. 2 shows an embodiment of the crane tower according to the present invention in a side view.

FIG. 2 shows a crane tower according to the present invention in a side view. A plurality of vertically spaced coupling elements 5, 52, 53 can be seen, which project from the crane tower 1. The coupling elements 5, 52, 53, which are arranged one above the other, are connected to a respective associated tension element 3; 4, 32; 42, 33; 43. Hence, it can be said that a bracing plane is defined in the case of each coupling element 5, 52, 53 arranged on a specific level of the crane tower 1. According to the present embodiment, a next higher bracing plane, which already has a bracing plane extending therebelow, is connected by a tension element 4; 3 to said bracing plane extending therebelow.

This will be particularly advisable for cranes which are increased in height through climbing. For this purpose, a coupling element 5 is connected via a tension element 3; 4 to a crane tower base 2 in a first step. The coupling elements 5 arranged closest to the ground 7 define the first bracing plane. If the crane tower 1 should additionally gain height beyond said first plane, so that further bracing of the crane tower 1 will make sense, the crane tower base 22 will define the first bracing plane for the bracing plane extending thereabove. The coupling element 52 is thus connected to the crane tower base 22 with the aid of a tension element 32; 42. The same applies to a third bracing plane, which is arranged above the second bracing plane and the coupling elements 53 of which are fixed to a crane tower base 23 via a respective tension element 33; 43. Thus, it is possible that the tension elements increase in height similar to a climbing of the crane tower 1.

Figure 3:
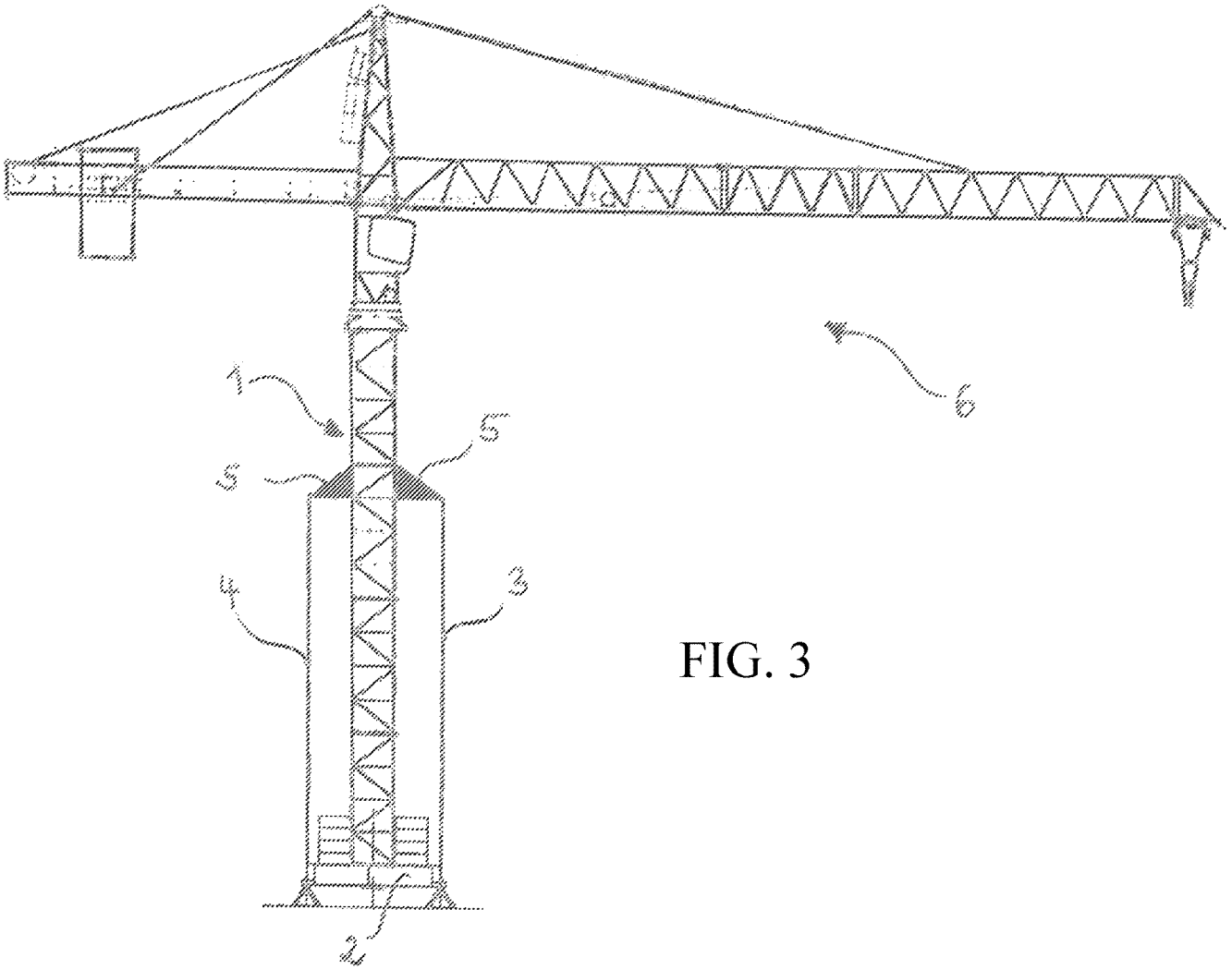
FIG. 3 shows, in a side view, a top-slewing tower crane including a crane tower according to the present invention.

FIG. 3 shows a top-slewing tower crane 6 comprising a crane tower 1 according to the present invention. The crane tower base 2 according to this embodiment is an X-pattern foundation or an undercarriage. This X-pattern foundation or this undercarriage is connected to a tension element 3; 4 which extends up to a coupling element 5.

The invention claimed is:

1. A crane tower comprising:

a crane tower base, which has the crane tower fixed thereto and from which the crane tower extends upwards, a tension element for bracing the crane tower on the crane tower base, the tension element having one of two ends connected to the crane tower base and a respective other end of the two ends connected to a first coupling element, wherein the crane tower base is a foundation of the crane tower, and a plurality of intermediate coupling elements positioned between the first coupling element and the crane tower base, the plurality of intermediate coupling elements further connecting the tension element to the crane tower, wherein the first coupling element is connected to the crane tower and the plurality of intermediate coupling elements is connected to the crane tower, wherein the tension element extends outside of the crane tower, and wherein the tension element is parallel to the crane tower from the first coupling element to the crane tower base, including along and between each of the plurality of intermediate coupling elements.

2. The crane tower according to claim 1, wherein the first coupling element, which is connected to one end of the tension element, projects from the crane tower.

3. The crane tower according to claim 1, wherein the first coupling element and the plurality of intermediate coupling elements are evenly spaced apart from one another along a longitudinal direction of the crane tower.

4. The crane tower according to claim 1, further comprising a second tension element, the second tension element and the first tension element being located in a common plane.

5. The crane tower according to claim 4, wherein the first tension element and the second tension element are arranged mirror-symmetrically with respect to a mirror plane.

6. The crane tower according to claim 5, wherein the mirror plane extends through a longitudinal axis of the crane tower.

7. The crane tower according to claim 4, wherein the first tension element and the second tension element are each connected to a coupling element associated therewith.

8. The crane tower according to claim 4, wherein each tension element comprises a jacketed, high-strength fiber rope.

9. The crane tower according to claim 8, wherein the fiber rope comprises aramid fibers.

10. The crane tower according to claim 4, wherein the common plane comprises a longitudinal direction of the crane tower or extends parallel to the longitudinal direction of the crane tower.

11. The crane tower according to claim 1, wherein the first coupling element is a bracket, an adapter piece to a different type of crane tower, or a ball slewing ring support.

12. The crane tower according to claim 1, wherein the foundation of the crane tower is a concrete foundation.

13. The crane tower according to claim 1, wherein the crane tower is part of a climbing-type crane, and wherein the tension element climbs as a height of the climbing-type crane increases.

14. The crane tower according to claim 1, wherein the tension element extends vertically.

15. The crane tower according to claim 14, wherein the tension element extends in a direction perpendicular to a ground plane.

16. The crane tower according to claim 1, wherein a distance that the first coupling element and the plurality of intermediate coupling elements project outward from the crane tower is substantially equal.

17. A rotating tower crane including a crane tower, the crane tower comprising:

a crane tower base, which has the crane tower fixed thereto and from which the crane tower extends upwards, a tension element for bracing the crane tower on the crane tower base, the tension element being a high-strength fiber rope having one of two ends connected to the crane tower base and a respective other end of the two ends connected to a first coupling element, wherein the crane tower base is an undercarriage of the rotating tower crane, and wherein the first coupling element is connected to the crane tower and extends in a first direction relative to the crane tower, and one or more intermediate coupling elements positioned between the first coupling element and the crane tower base, the one or more intermediate coupling elements further connecting the tension element to the crane tower, wherein the one or more intermediate coupling elements are connected to the crane tower and extend in the first direction, wherein the tension element extends outside of the crane tower, the tension element parallel to the crane tower from the first coupling element to the crane tower base, including along and between each of the one or more intermediate coupling elements, and wherein the first coupling element and the one or more intermediate coupling elements are spaced apart along a longitudinal axis of the crane tower.

18. The crane rotating tower crane according to claim 17, wherein the first coupling element projects from the crane tower in a direction perpendicular to a longitudinal direction of the crane tower, and wherein a distance that the first coupling element and the one or more intermediate coupling elements project outward from the crane tower is substantially equal.

19. The rotating tower crane according to claim 17, wherein the rotating tower crane is a top-slewing tower crane.

20. The rotating tower crane according to claim 17, wherein the first coupling element and the one or more intermediate coupling elements are evenly spaced apart along the longitudinal axis of the crane tower.

* * * * *